US006536244B1

(12) United States Patent
Chang

(10) Patent No.: US 6,536,244 B1
(45) Date of Patent: Mar. 25, 2003

(54) COMPUTER SECURITY DEVICE

(76) Inventor: Chun-Yuan Chang, P.O. Box 55-175, Taichung (TW)

( * ) Notice: Subject to any disclaimer, the term of this patent is extended or adjusted under 35 U.S.C. 154(b) by 5 days.

(21) Appl. No.: 09/633,151

(22) Filed: Aug. 4, 2000

(51) Int. Cl.[7] ..... E05B 69/00; E05B 73/00
(52) U.S. Cl. ..... 70/58; 70/18; 70/49
(58) Field of Search ..... 70/14, 18, 49, 70/58

(56) References Cited

U.S. PATENT DOCUMENTS 5,381,685 A * 1/1995 Carl et al. ..... 70/78
5,913,907 A * 6/1999 Lee ..... 70/58
6,006,557 A * 12/1999 Carl et al. ..... 70/58
6,155,088 A * 12/2000 Murray, Jr. et al. ..... 70/58
6,170,304 B1 * 1/2001 Ohta ..... 70/14
6,199,413 B1 * 3/2001 McDaid et al. ..... 70/58
6,257,029 B1 * 7/2001 Liao ..... 70/58

* cited by examiner

*Primary Examiner*—Lynne H. Browne
*Assistant Examiner*—John B. Walsh
(74) *Attorney, Agent, or Firm*—Rosenberg, Klein & Lee

(57) ABSTRACT

A security device is provided wherein spindle is engaged with a lock pin and the spindle is engaged with an abutment plate such that a locking/unlocking of the security device is effected by simply using one hand to rotate the spindle to cause the lock pin to rotate together. This device can inhibit the theft of small but expensive pieces such as a computer or the like.

3 Claims, 9 Drawing Sheets

COMPUTER SECURITY DEVICE

FIELD OF THE INVENTION

The present invention relates to devices for inhibiting the theft of small but expensive pieces such as a computer or the like.

BACKGROUND OF THE INVENTION

A conventional computer security device is disclosed in U.S. Pat. No. 5,381,685 entitled "Computer Physical Security Device" as shown in FIGS. 1 and 2. The device comprises a nose-piece 1, a hollow shell 2, a spindle 3, and a cylindrical collar 4.

Collar 4 is put on shell 2 which is in turn inserted into nose-piece 1. As such, collar 4 is secured between nose-piece 1 and plate 201. There is an aperture (not shown) provided through the aperture plate 201. Spindle 3 is permitted to rotate a limited range with respect to shell 2. Spindle has an aperture (not shown) on the aft surface for key (not shown) to insert through for rotating spindle 3. A shaft 301 is projected on front end of spindle 3. A crossmember 302 is provided at the free end of shaft 301. An abutment mechanism 303 is put on shaft 301. Abutment mechanism 303 comprises a pair of pins 304 with shaft 301 inserted therebetween. Ends of pins 304 are extended outwardly through nose-piece 1. A cable 401 is dead-ended into a tab of collar 4. Thus forms the computer security device.

In an unlocked position, pins 304 and crossmember 302 are aligned in engagement, while in a locked position, pins 304 and crossmember 302 are misaligned in engagement as best illustrated in FIGS. 3 and 4. In use, cable 401 is wrapped around a relatively immovable object (not shown) such as the cross bar spanning two legs of a desk. Then insert a key engaging lock mechanism into keyhole to rotate spindle 3 to make the security device in an unlocked position. Next, insert the aligned shaft 301 and pins 304 into slot 901 of an exterior wall 9 of the piece of equipment (e.g., computer keyboard) to be protected until the crossmember 302 fully passes over the slot 901 to be located inside the exterior wall 9 of the piece of equipment. Then rotate key 5 to cause spindle 3 together with shaft 301 and crossmember 302 to rotate 90° for engaging crossmember 302 with the exterior wall 9. By utilizing this, the security device is extremely difficult to disengage by anyone not having the appropriate key 5. As a result, the purpose of inhibiting the theft of the piece of equipment is achieved.

However, the previous design suffered from disadvantages. That is, it is required for an operator to use one hand to hold the nose-piece 1 and the other hand to insert a key into keyhole to rotate spindle 3 for locking/unlocking the security device. This is quite inconvenient. Also, the special key can be lost of misplaced. As a result, a recognized need still exists for an improved computer security device.

SUMMARY OF THE INVENTION

It is an object of the present invention to provide a security device wherein a spindle is engaged with a lock pin and the spindle is engaged with an abutment plate such that a locking/unlocking of the security device is effected by simply using one hand to rotate the spindle to cause the lock pin to rotate together. This device can inhibit the theft of small but expensive pieces such as a computer or the like.

The above and other objects, features and advantages of the present invention will become apparent from the following detailed description taken with the accompanying drawings.

DETAILED DESCRIPTION OF THE PREFERRED EMBODIMENTS

Figure 1:
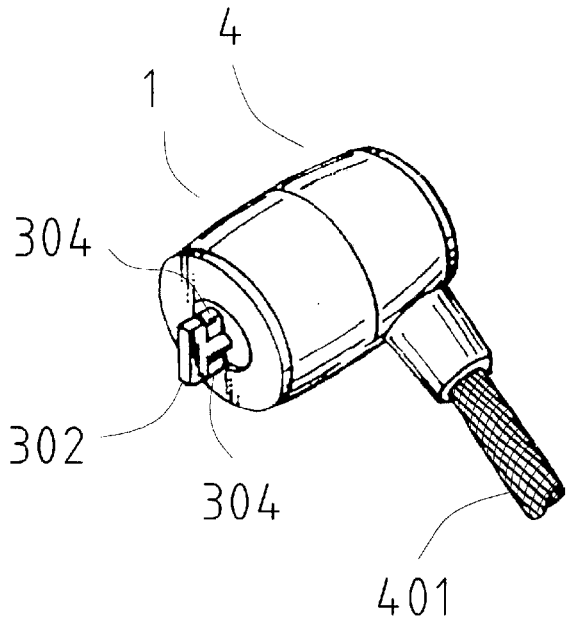
PRIOR ART FIG. 1
FIG. 1 is a perspective view of the attachment mechanism of U.S. Pat. No. 5,381,685.
Figure 3:
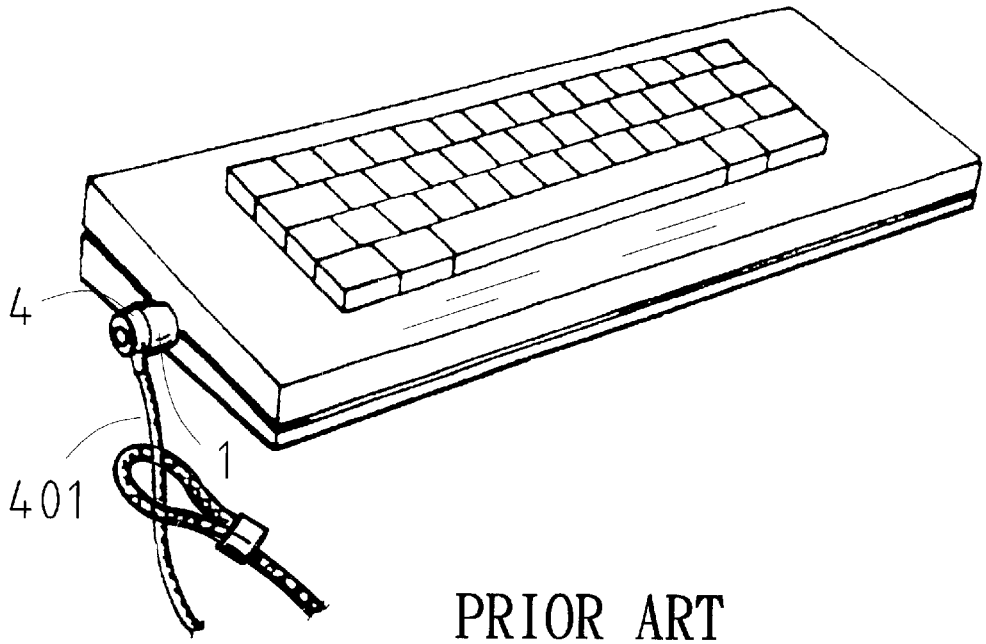
PRIOR ART FIG. 3
FIG. 3 is a perspective view of the FIG. 1 attachment mechanism attached to a computer keyboard.
Figure 2:
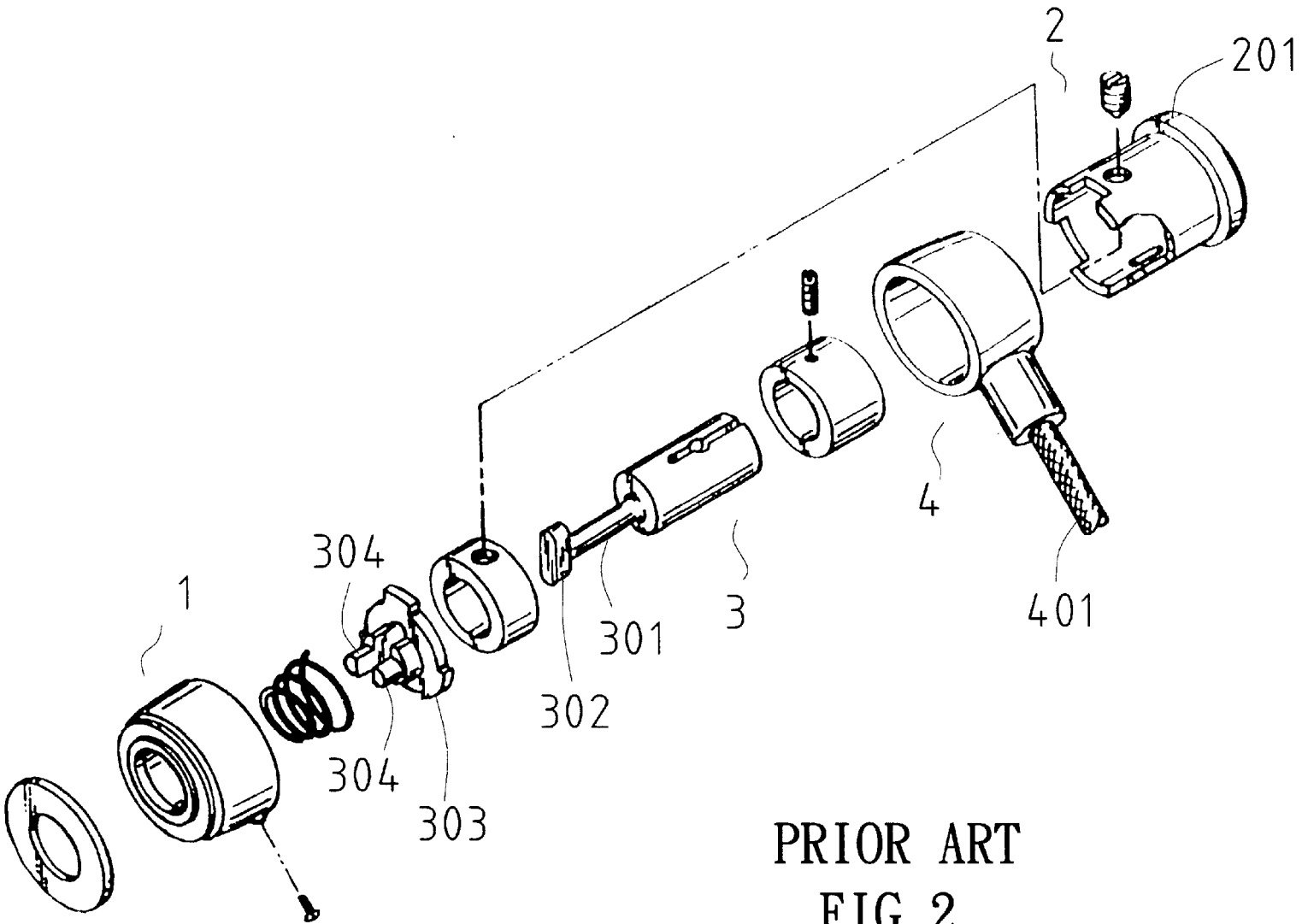
PRIOR ART FIG. 2
FIG. 2 is an exploded view of the FIG. 1 attachment mechanism.
Figure 4:
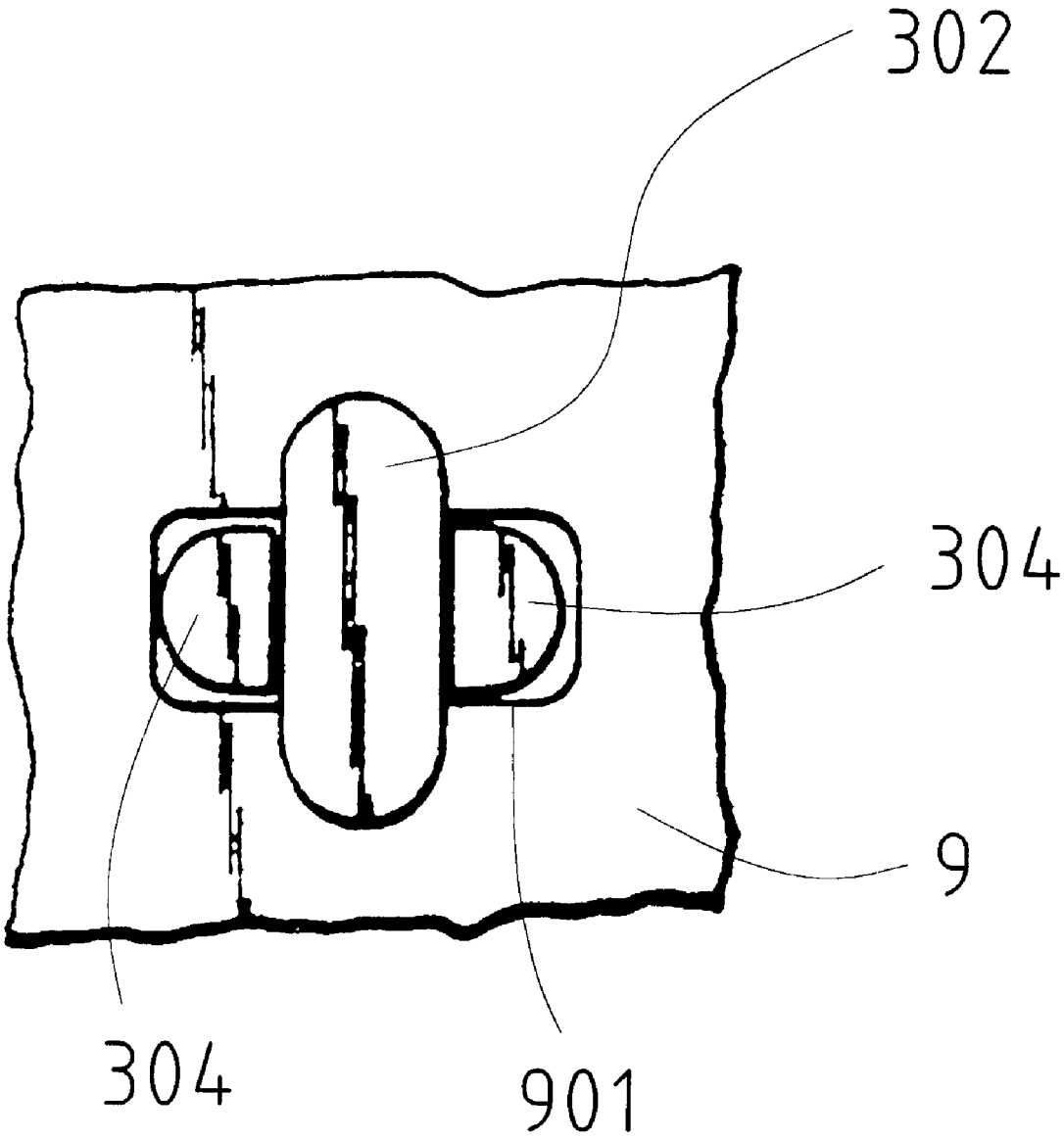
PRIOR ART FIG. 4
FIG. 4 is a side view illustrating the installation of the FIG. 3 attachment mechanism.
Figure 5:
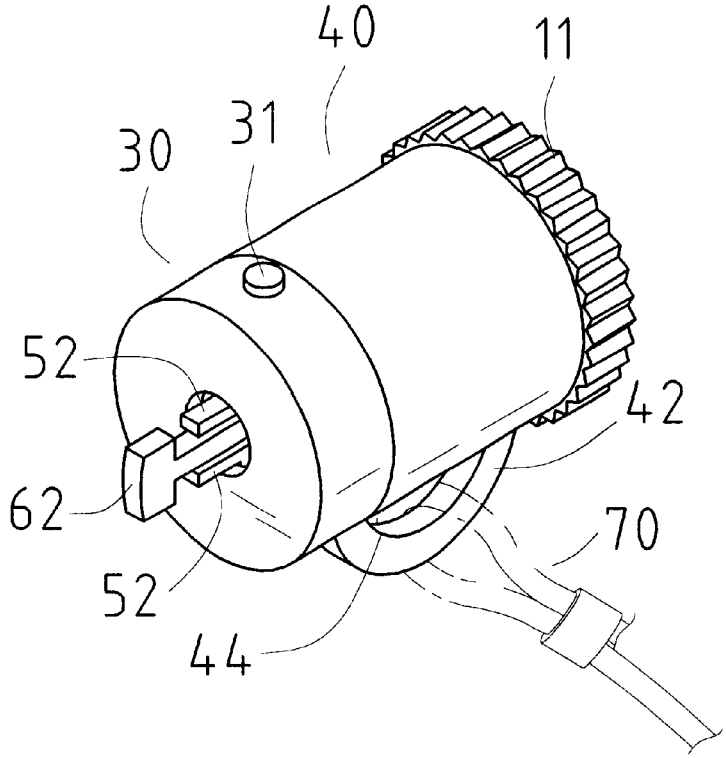
FIG. 5 is a perspective view of a first preferred embodiment of computer security device according to the invention.

Referring to FIGS. 5 to 10, there is shown a computer security device constructed in accordance with the invention comprising a hollow shell, a spindle 20, a housing 30, and a cylindrical collar 40. Spindle 20 is prior art comprising a plurality of axially disposed elastic risers 21 on the surface, a raised plate 22 on the aft end, and a stopper 23 in the front of elastic riser 21 so as to bias elastic risers 21 to retract into spindle 20 by the guiding of the raised edges of a key (not shown) when the key is inserted into the keyhole. The detailed description of spindle 20 is omitted herein since spindle 20 is prior art. Hollow shell 10 comprises a raised plate 11 having a plurality of raised portions around the circumference in the art end. A blunt pin (or set screw) 31 is inserted through the aperture of housing 30 and the aperture of hollow shell 10 to secure housing 30 to hollow shell 10. Collar 40 is put on and pivotable with respect to hollow shell 10. Collar 40 is disposed between and defined by housing 30 and raised plate 11. Spindle 20 is pivotably disposed in hollow shell 10.

Figure 7:
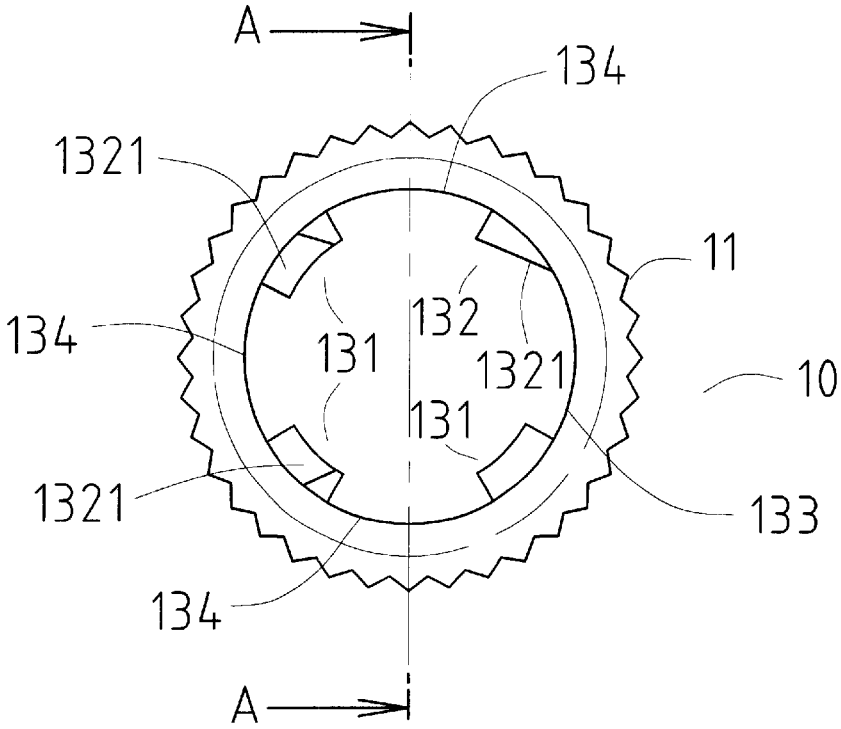
FIG. 7 is a plan view of the aft end of the FIG. 5 security device.
Figure 8:
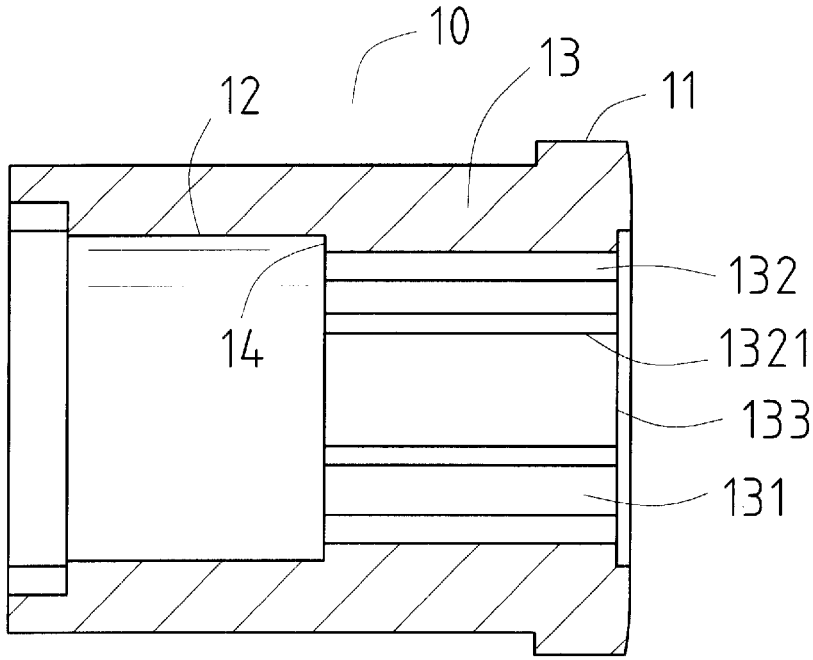
FIG. 8 is a cross-sectional view taken along line A—A of FIG. 7.

Referring to FIGS. 7 and 8 specifically, the interior features of hollow shell 10 will now be described. Hollow shell 10 further comprises an interior cylindrical cavity 12 adjacent housing 30 on one end, a cylindrical portion 13 on the other end, and a shoulder 14 attached between interior cylindrical cavity 12 and cylindrical portion 13. Three first projections 131 and a second projection 132 are provided around the inside surface of cylindrical portion 13. Accordingly, a first groove 133 and three second grooves 134 are equally formed between second projection 132 and first projections 131, that is, one groove is perpendicular to the adjacent groove in orientation. A slope 1321 is formed on one side of second projection 132 extended from the tip of second projection 132 to first groove 133. Spindle 20 is pivotably provided in cylindrical portion 13 with elastic riser 21 engaged with first groove 133. Stopper 23 is engaged with shoulder 14 in interior cylindrical cavity 12. Raised plate 22 is engaged with first projections 131 and second projection 132 such that spindle 20 is pivotably provided in hollow shell 10.

An abutment plate 50 is provided in interior cylindrical cavity 12 comprising a rectangular opening 51. Spindle 20 is inserted into interior cylindrical cavity 12. Two pins 24 are formed on the front end of spindle 20. The aft end of abutment plate 50 is provided between pins 24, while the front end formed as two straight parallel members 52 are extended through the front aperture of housing 30. A channel 522 is formed between straight parallel members 52 in communication with opening 51. A lock pin 60 is pivotably provided in channel 522. Lock pin 60 comprises two wing members 61 on both sides of opening 51 and a projected crossmember 62 on the free end thereof extended beyond channel 522. Two sides of wing member 61 are perpendicular to each other. Two wing members 61 are engaged with two front opposite recesses 15 for securing lock pin 60 to hollow shell 10. Two studs 32 are axially projected on the front inner surface of housing 30 to engage with wing members 61.

Also, two opposite slots (not shown) are formed on the inside of interior cylindrical cavity 12. A protuberance 25 is formed on the surface of spindle 20 opposite to elastic risers 21. Protuberance 25 is inserted in recesses 1312 for defining the rotational angle of hollow shell 10. A lug 42 is provided on the surface of collar 40, thus forming a hole 44 for allowing cable to pass through.

Figure 9:
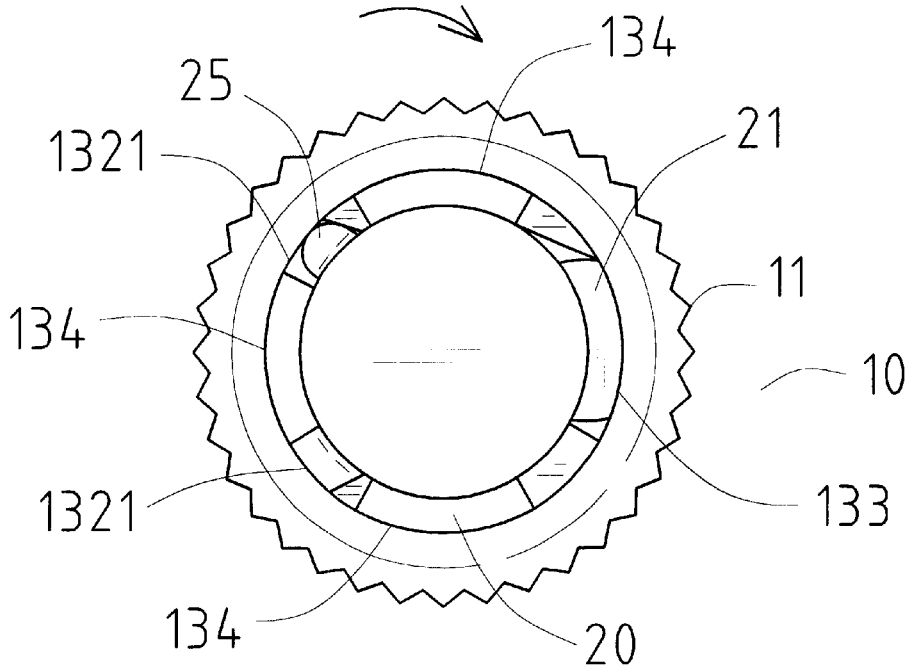
FIG. 9 is a view similar to FIG. 7 depicting the operation of the FIG. 5 security device.
Figure 10:
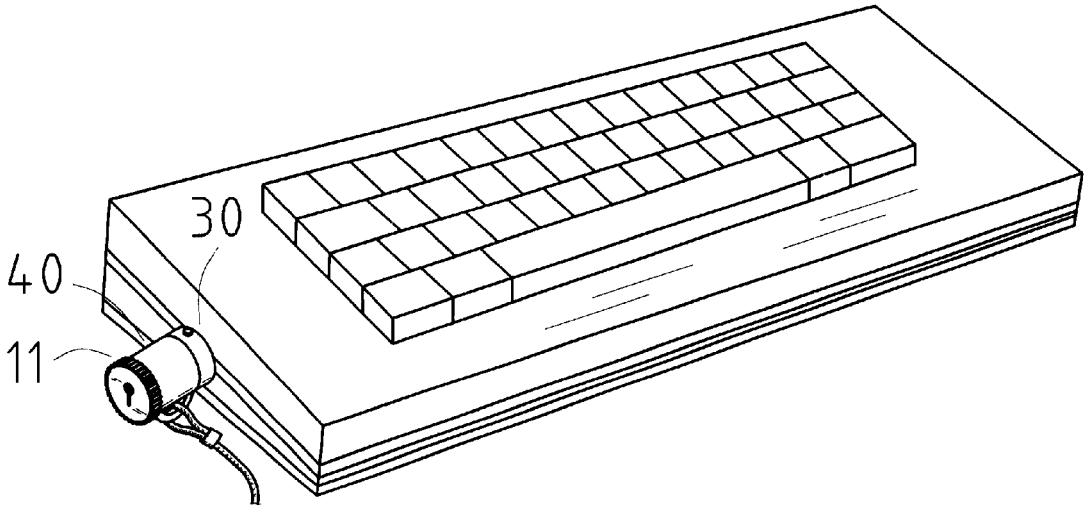
FIG. 10 is a perspective view of the FIG. 5 security device attached to a computer keyboard.

As shown in FIG. 9, in an unlocked position, elastic risers 21 are inserted into first groove 133 and straight parallel members 52 are aligned with crossmember 62. As such, it is possible to insert the aligned straight members 52 and lock pin 60 into a generally rectangular slot of an exterior wall (not shown) of the piece of equipment (e.g., computer keyboard) to be protected until the crossmember 62 fully passes over the slot to be located inside the exterior wall of the piece of equipment. Then rotate hollow shell 10 by turning raised plate 11 to pivot hollow shell 10 with respect to spindle 20. And in turn slopes 1321 bias against elastic risers 21 to cause elastic risers 21 to move away from first groove 133 to retract into spindle 20 such that second projection 132 passes over elastic risers 21. Second projection 132 is moved to the other sides of elastic risers 21 when hollow shell 10 is rotated 90°. At this time, elastic risers 21 return to the original uncompressed form to insert into second groove 134 adjacent second projection 132. Lock pin 60 is rotated together with hollow shell 10. Crossmember 62 is also rotated 90° to become misaligned with straight members 52 to engage with the exterior wall of keyboard. At this position, the security device is locked. Note that cable 70 has previous passed through a plurality of pieces of equipment and wrapped around a relatively immovable object (not shown) such as the cross bar spanning two legs of a desk. Thus, the purpose of inhibiting the theft of the piece of equipment is achieved.

In unlocking the device, insert a key into the aperture of spindle 20 to disengage elastic risers 21 from second grooves 134 for retracting into spindle 20 by the guiding of the raised edges of key, thus disengaging protuberance 25 from recess 1312. Also, hollow shell 10 is defined to rotate in a given single direction such that first groove 133 together with hollow shell 10 rotate 90° to move to a position opposite to elastic risers 21. That is, crossmember 62 is turned 90° to align with straight members 52 for returning to unlocked position. Then pull lock pin 60 and straight members 52 out of the exterior wall of keyboard. At this time, elastic risers 121 are inserted into first groove 133 again.

Figure 13:
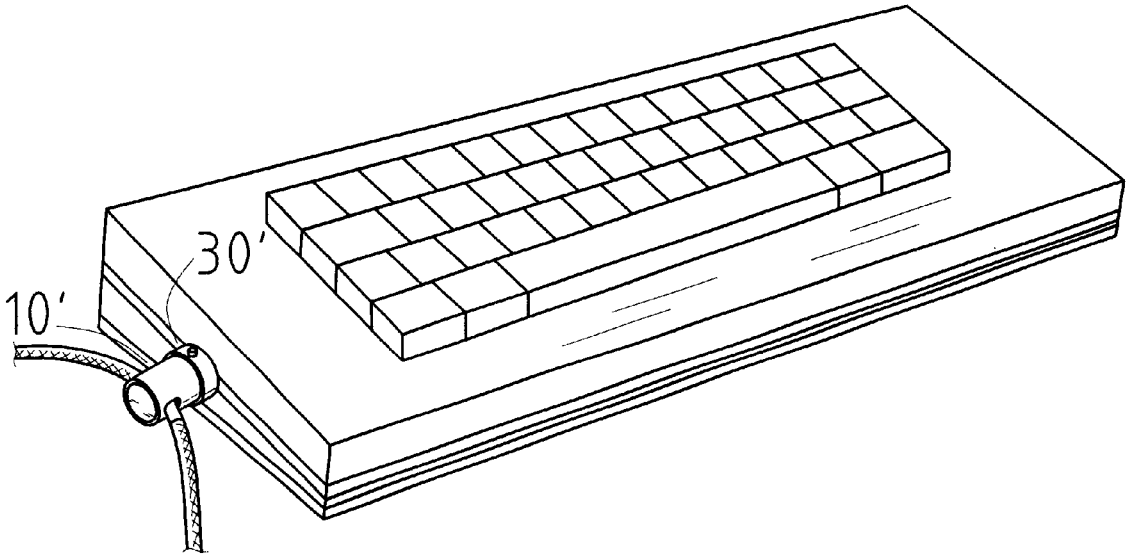
FIG. 13 is a perspective view of the FIG. 11 security device attached to a computer keyboard.
Figure 6:
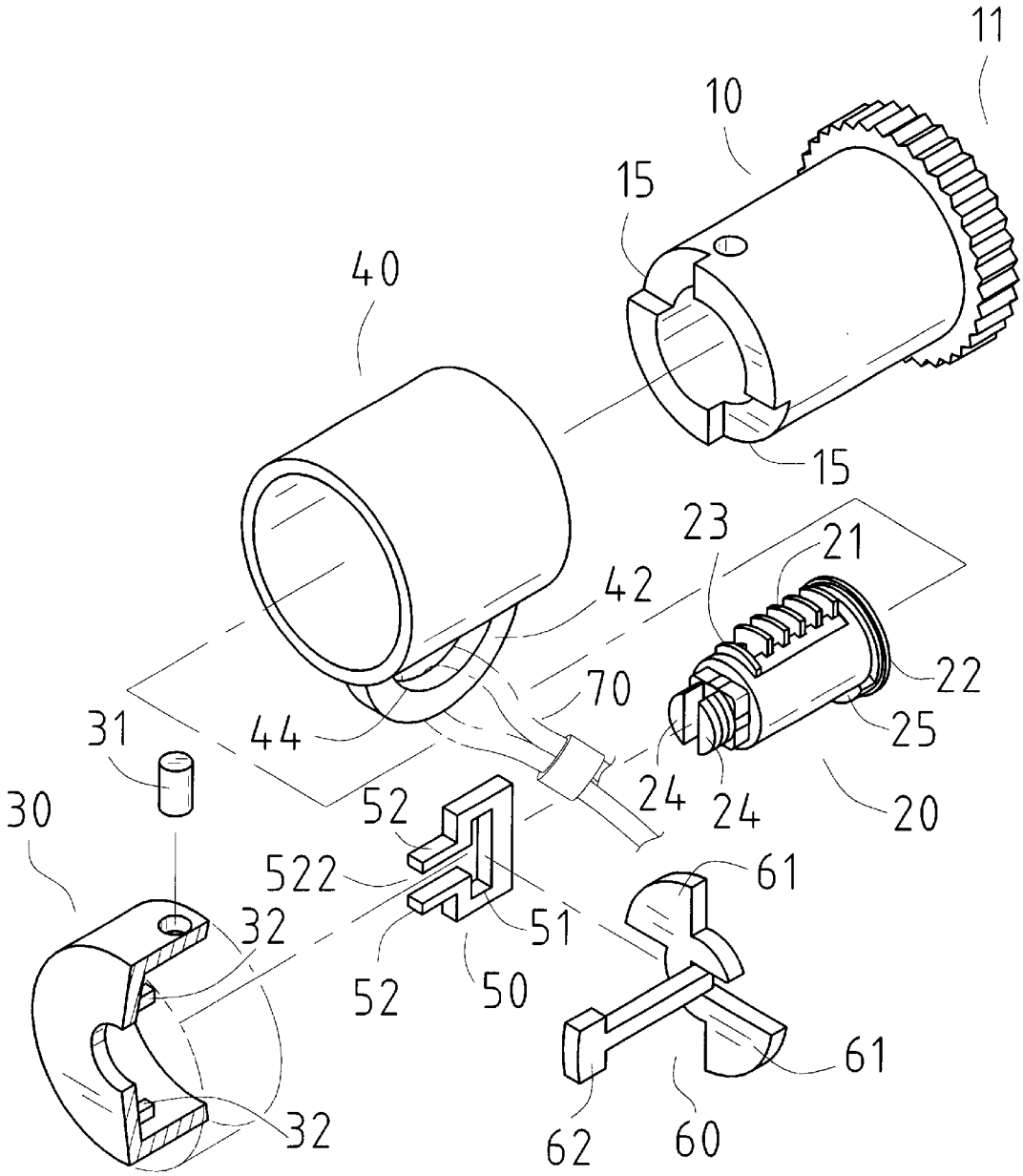
FIG. 6 is an exploded view of the FIG. 5 security device.
Figure 11:
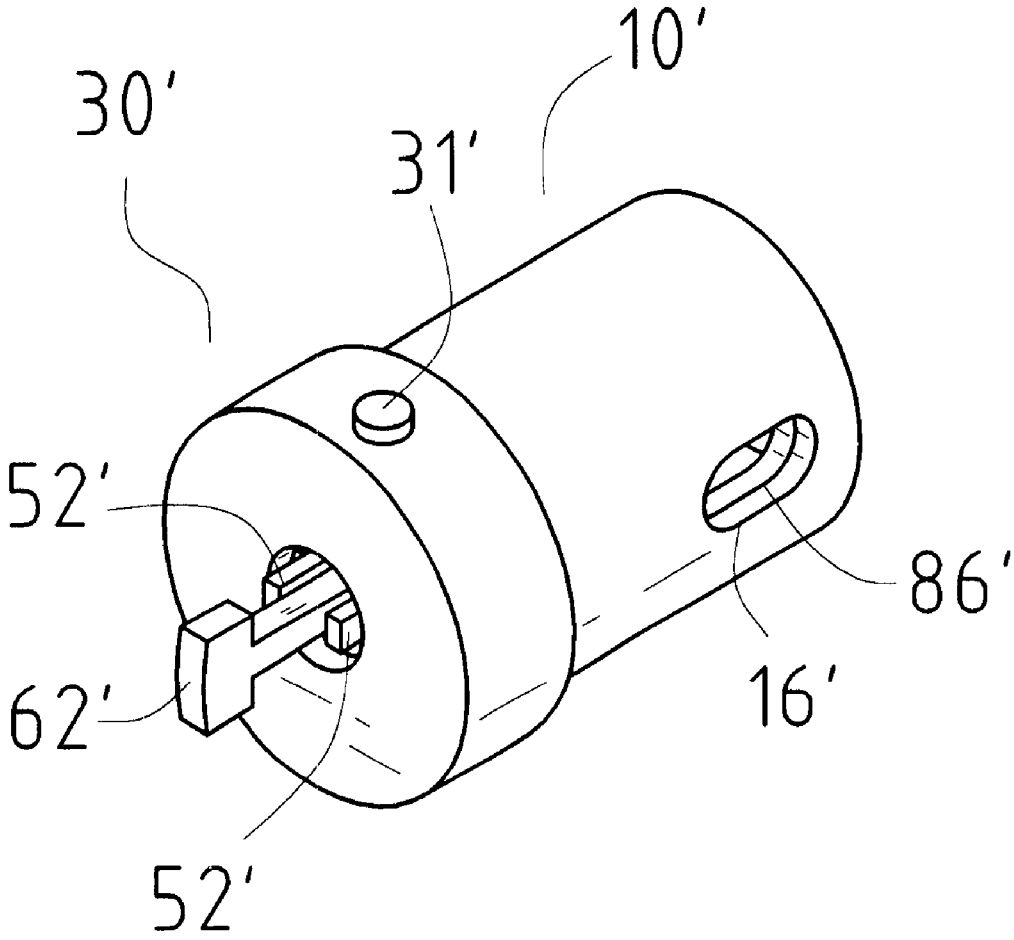
FIG. 11 is a perspective view of a second preferred embodiment of computer security device according to the invention.
Figure 12:
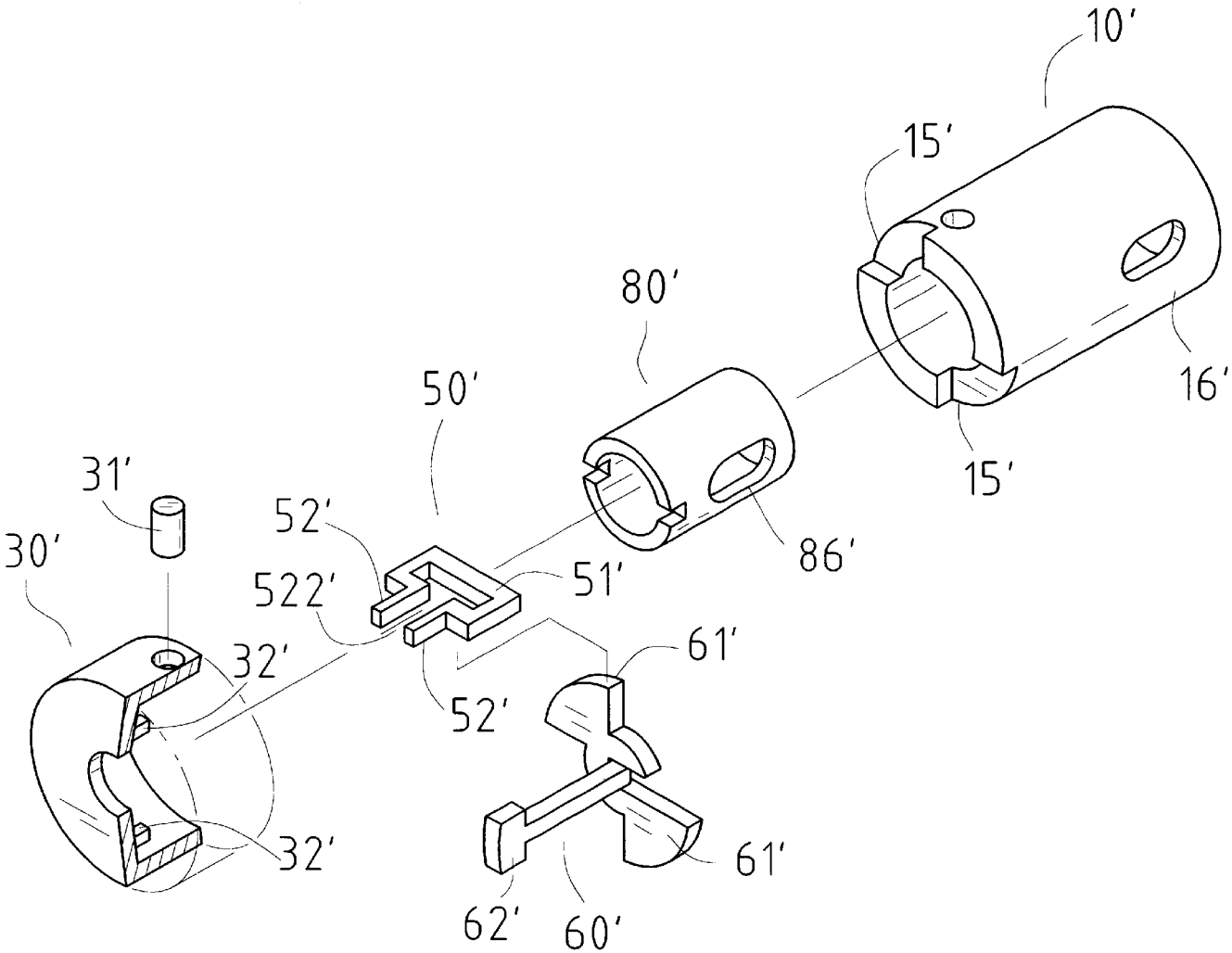
FIG. 12 is an exploded view of the FIG. 11 security device.

Referring to FIGS. 11 to 13, a second preferred embodiment of computer security device according to the invention will now be described. The device comprises a hollow shell 10', a cylindrical collar 80' pivotably provided in hollow shell 10', and a housing 30' put on hollow shell 10' having a pin 31' inserted through the aperture of housing 30' and the aperture of hollow shell 10' to lock housing 30' to hollow shell 10'.

Similar to that of the first embodiment, an abutment plate 50' comprises a rectangular opening 51'. The front end of abutment plate 50' formed as two straight parallel members 52' are extended through the front aperture of housing 30'. A channel 522' is formed between straight members 52' in communication with opening 51'. A lock pin 60' is pivotably provided in channel 522'. Lock pin 60' comprises two wing members 61' on both sides of opening 51' and a crossmember 62' on the free end thereof extended beyond channel 522'. Two sides of wing member 61' are perpendicular to each other. Two wing members 61' are engaged with recesses 15' for securing lock pin 60' to hollow shell 10'. Two studs 32' are axially projected on the front inner surface of housing 30' to engage with wing members 61'.

A first through aperture 16' is formed on hollow shell 10'. Correspondingly, a second through aperture 86' is formed on collar 80'. In an unlocked position, straight members 52' are aligned with crossmember 62' and thus first and second through apertures 16', 86' are in communication. Then insert the aligned straight members 52' and lock pin 60' into slot of an exterior wall of the piece of equipment (e.g., computer keyboard) to be protected until the crossmember 62' fully passes over the slot to be located inside the exterior wall of the piece of equipment. Then rotate hollow shell 10' with respect to collar 80' together with crossmember 62' rotated 90° to become misaligned with straight members 52' to engage with the exterior wall of keyboard. At this position, the security device has been locked. Operator may easily pass cable through the passageway formed by the aligned through apertures 16', 86'. The presence of cable prevents hollow shell 10' from being rotated back to unlock the device. Similarly, operator may pass cable through a plurality of pieces of equipment and wrapped around a relatively immovable object (not shown) such as the cross bar spanning two legs of a desk. Thus, the purpose of inhibiting the theft of the piece of equipment is achieved. Operator may rotate hollow shell 10' by manipulating crossmember 62' until crossmember 62' is 90° misaligned with respect to straight members 52. At this position, the device is unlocked.

While the invention herein disclosed has been described by means of specific embodiments, numerous modifications and variations could be made thereto by those skilled in the art without departing from the scope and spirit of the invention set forth in the claims.

What is claimed is:

1. A device for inhibiting theft of equipment having an exterior wall with a generally rectangular slot member, the device comprising:

a rear hollow shell including a raised plate having a plurality of raised portions around the circumference in the aft end, an interior cylindrical cavity on one end, a cylindrical portion on the other end, a shoulder attached between the cavity and the cylindrical portion, three first projections and a second projection around the inside surface of the cylindrical portion, a first groove and three second grooves equally formed between the second and the first projections, a slope formed on a side of the second projection extended from the tip of second projection to the first groove, two opposite slots inside the interior cylindrical cavity, and two opposite recesses on the front surface;

a spindle pivotably provided in the shell including a plurality of axial elastic risers on the surface engaged with the first groove, a raised plate on the aft end, a stopper in the front of the elastic risers engaged with the shoulder, and a protuberance on the surface opposite to the elastic risers being inserted in the recesses for defining the rotational angle of the hollow shell;

a front hollow cylindrical housing;

a cylindrical collar having a lug on the surface;

a cable having one end connected to an immovable object and adapted to form a closed loop around the lug at the other end, thus inhibiting theft of the equipment;

an abutment plate in the interior cylindrical cavity including a rectangular opening, a pair of front straight members extended through the housing, a channel between the straight members in communication with the opening; and a lock pin pivotably provided in the channel includes two wing members on both sides of the opening engaged with the recesses respectively for securing the lock pin to the hollow shell and a projected crossmember on the free end thereof extended beyond the channel;

wherein in use, the elastic risers are inserted into the first groove, the straight members are aligned with the crossmember such that the aligned straight members and the lock pin are insertable into the slot member of the exterior wall in a position that the crossmember is inside the exterior wall, and then rotate the hollow shell with respect to the spindle such that the slopes bias against the elastic risers to force the elastic risers to move away from the first groove to retract into the spindle, the second projection passes over the elastic risers when the hollow shell is rotated 90°, the elastic risers return to the original uncompressed form to insert into the second groove adjacent to the second projection, and the lock pin is rotated together with the hollow shell to cause the crossmember to become misaligned with the straight members so as to attach the device rigidly to the exterior wall.

2. The device of claim 1, further comprising two studs axially projected on the front inner surface of the housing to engage with the wing members respectively.

3. The device of claim 1, wherein the spindle further comprising two pins formed on the front end with the aft end of the abutment plate provided between the pins.

* * * * *